United States Patent [19]

Witte

[11] 4,320,373

[45] Mar. 16, 1982

[54] POWER TRANSFORMER WITH HIGH COUPLING COEFFICIENT

[75] Inventor: Walter R. Witte, Asbury, N.J.

[73] Assignee: RCA Corporation, New York, N.Y.

[21] Appl. No.: 207,720

[22] Filed: Nov. 17, 1980

Related U.S. Application Data

[62] Division of Ser. No. 63,806, Aug. 6, 1979, Pat. No. 4,258,467.

[51] Int. Cl.[3] ..... H01F 27/30

[52] U.S. Cl. ..... 336/183; 336/192; 336/206

[58] Field of Search ..... 336/192, 180, 182, 183, 336/187, 206

[56] References Cited

U.S. PATENT DOCUMENTS 3,159,804 12/1964 Vogel ..... 336/187

3,721,932 3/1973 Fierstien et al. ..... 336/183 X

*Primary Examiner*—Thomas J. Kozma

*Attorney, Agent, or Firm*—Samuel Cohen; William Squire

[57] ABSTRACT

A primary coil and N secondary coils of insulated electrically conductive wire are wound side-by-side about a ferrite core. Every T turns, the wire forming the secondary coils is wound over a separator strip forming an array of loops. A pair of spaced parallel conductors, for displacing the separator strip, are inserted in the array of loops and are soldered to the loops. The loop portion in the space between the conductors is removed. The assembly is covered with a layer of insulating material. The windings are repeated in a second or more layers over the first layer until the desired number of primary and secondary turns is formed.

5 Claims, 9 Drawing Figures

Figure 1:
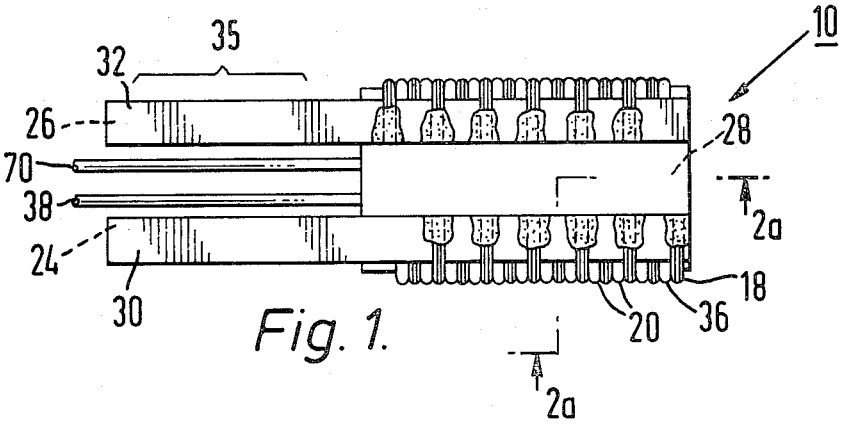

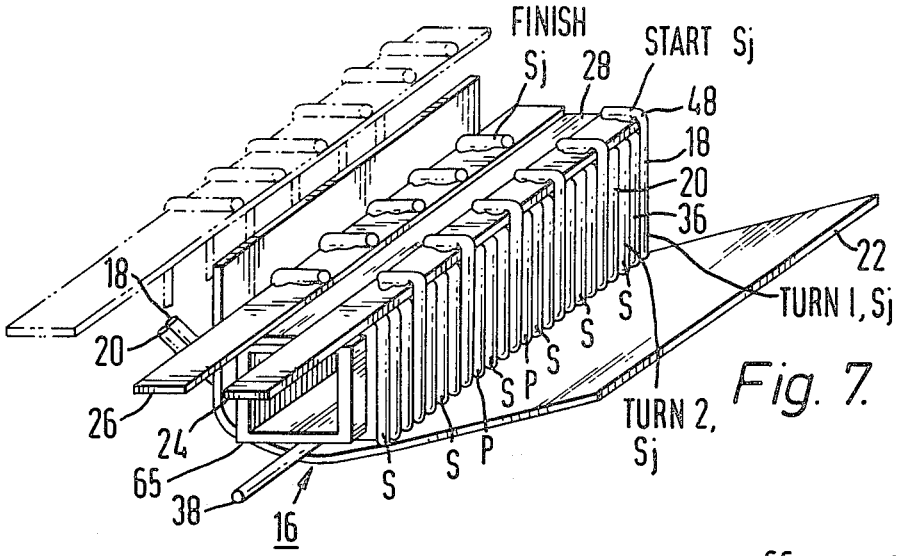
Fig. 7.
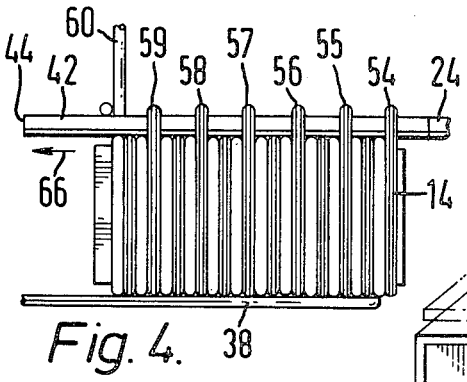
Fig. 4.
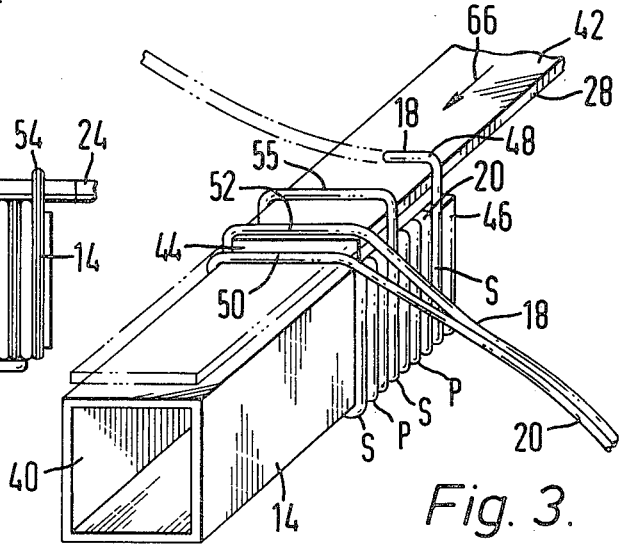
Fig. 3.
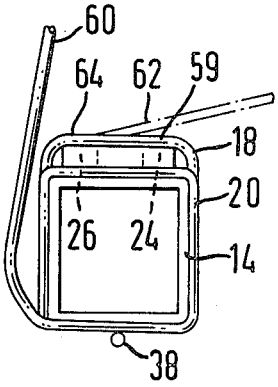
Fig. 5.
Fig. 6a.
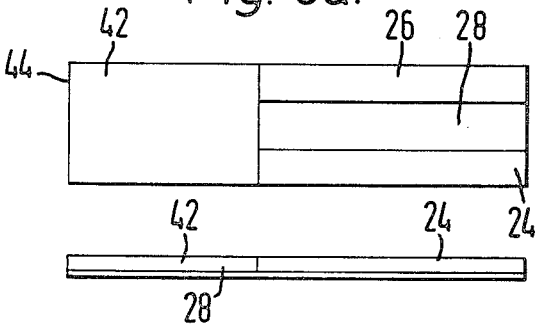
Fig. 6b.

POWER TRANSFORMER WITH HIGH COUPLING COEFFICIENT

This is a division, of application Ser. No. 063,806, now U.S. Pat. No. 4,258,467, filed Aug. 6, 1979.

The present invention relates to power transformers having high coupling coefficients.

As the operating frequency of a transformer increases, the energy that can be transferred from a circuit at the primary coil of the transformer to a circuit at the secondary coil of a transformer becomes limited by the rate at which the primary current increases (di/dt). If the time (dt) required for a given change in current (di) to occur is a significant portion of a half cycle, the energy transfer through, and the frequency response of, the transformer deteriorates. The rate di/dt is dependent on the voltage E applied across the primary coil and the magnitude of the leakage inductance L between the primary and secondary coils, that is, $(di/dt) \simeq E/L$. L, in turn, is a function of the coupling coefficient (K) between the primary and secondary coils, K representing the percentage of the generated magnetic flux linking the two coils.

An ideal transformer has a coupling coefficient of 100 percent ($K=1$). To approach this ideal, a turn-for-turn and length-for-length match should exist between the primary and secondary conductors.

At low turns ratios such as two-to-one or three-to-one between a primary and secondary coils, this coupling coefficient is achieved by using equal numbers of strands of insulated primary and secondary conductors, winding them together, and connecting the primary strands in series and the secondary strands in parallel, or vice versa. For example, see U.S. Pat. No. 3,721,923 where a broad band radio frequency transformer for use in the frequency range of 25–175 MHz includes closely coupled windings on a ferrite rod, providing low leakage inductance. Each primary coil is bifilar wound with a portion of the secondary coil. The number of turns in the secondary coil is equal to the total number of turns in all the primary coils, or may be up to 50 percent greater than the total number of turns in the primary coil. There is disclosed three primary coils and one secondary coil. However, the coil comprises a single layer of windings and the secondary leads terminate in a printed circuit board. This is a special case. For power transformers, the windings are made in layers and this circuit board mounting technique is not practical.

For power transformers, with turns ratios between the two coils greater than four, the bifilar winding technique becomes unwieldy. At high frequencies, for example at 40 KHz, the leakage inductance induced by the excessive number of terminations makes this technique self-defeating. That is, with turns ratios greater than four, the requirement that each set of secondary leads be brought out for terminal purposes from the secondary coils in the various layers of a power transformer would result in a cumbersomely large number of secondary leads. For example, in an 18 to 1 turns ratio power transformer having a primary coil of 36 turns, each secondary coil would have 2 turns and there would be a total of 18 secondary coils which would mean 36 leads from the secondary coils. Such a large number of leads, which would have to be exited from the windings for connection to external circuits, would be unwieldy. This is coupled with the usual practice in power transformers of "layering" the coils, that is, first winding a primary coil and then winding the secondary coils about the primary coil or vice versa, also reduce the coupling coefficient.

A power transformer in accordance with the present invention can provide turns ratio beyond 20 to 1 in a compact assembly and can provide coupling coefficients greater than 99.5 percent. First and N second coils are formed of insulated electrical conductors, each second coil has T turns, where N is greater than 4 and T is at least 1. The first coil has M turns, where M is $N \times T$, the turns of all the coils being wound about the core about a common axis and forming at least two concentric cylindrical windings of turns, each turn of the second coils being adjacent to a separate different turn of the first coil to form an array of alternating first and second bifilar coils turns along each of the cylindrical layers. At least two spaced current carrying conductors for each layer are included as start and finish current busses for the N second coils wound about that layer.

Figure 2A:
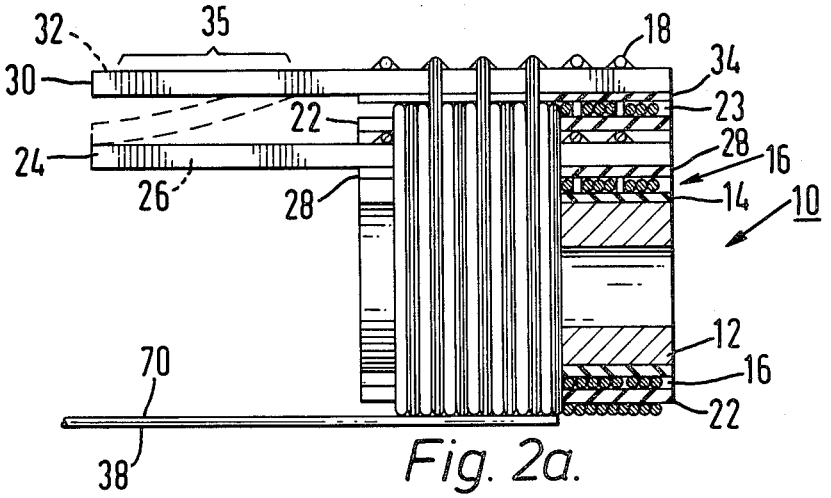
Figure 2B:
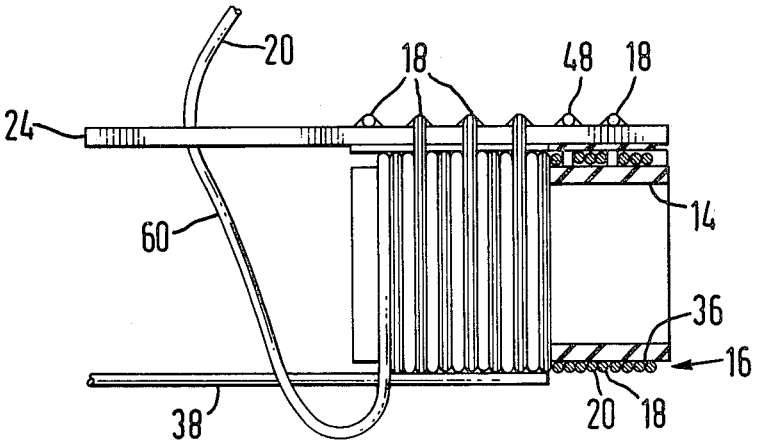

In the drawing:

FIG. 1 is a plan view of an embodiment of a transformer constructed in accordance with the present invention, FIGS. 2A and 2B are side elevational partial sectional views of the construction of FIG. 1 taken along lines 2—2 at different stages of the construction, FIG. 3 is an isometric view illustrating the procedure used in winding the coils of the transformer of FIG. 1, FIG. 4 is a side elevational view of a transformer in the process of being assembled, FIG. 5 is an end view of the transformer of FIG. 4., FIGS. 6*a* and 6*b* are plan and side elevational views of an assembly tool and secondary coil conductor assembly used in the contruction of the transformer of FIG. 1, and FIG. 7 is an isometric view of a later stage of the assembly of the transformer of FIG. 4.

The transformer 10 of FIGS. 1 and 2A includes a ferrite core 12 which comprises a hollow cylinder of square cross-section. The word "cylindrical" is used througout the description herein and in the appended claims to connote a surface traced by a straightline which is moved along a path parallel to a fixed straight line and thus, when applied to coils, is intended to be generic to those of circular, rectangular, D-shaped, oval and other cross sections. A square cylinder of insulating material 14, such as paper, is located over the ferrite core 12. This is followed by a first layer 16 of insulated conductors on the paper, these conductors comprising primary and secondary coils. The alternate conductors 18 of layer 16 form the secondary coils and the alternate conductors 20 form the primary coil. For ease of illustration and understanding of the drawing, the secondary conductors 18 are heavily shaded and the primary conductors 20 are lightly shaded.

An insulating cylinder 22, which may be formed of kraft paper, is over the first layer 16 and a second layer 23 of conductors is on the cylinder 22. This second layer forms a group of secondary windings and a primary winding in a manner analogous to layer 16, as will be described later. An insulator (not shown) is over the second layer 23 of insulated conductors.

A pair of bus conductors 24 and 26 for the secondary coils of layer 16 is insulated from the first layer 16 by the rectangular insulating sheet 28 (see FIGS. 3 and 7) which may be formed of kraft paper. Bus conductors 24 and 26 are highly electrically conductive and may be made of any suitable metal such as copper. The conductors may be relatively thin but are of sufficient cross-section and of proper temper that they may be bent and when bent retain their new shape. The conductors may be cemented to the sheet 28.

A second pair of bus conductors 30 and 32 for the secondary coils of layer 23 is mounted similarly to a second sheet of paper insulator 34, which is similar in construction to sheet 28, sheet 34 being over the second layer 23 of conductors. Bus conductors 30 and 32 align with conductors 24 and 26, respectively, and the two insulating sheets 28 and 34 also align with one another. The conductors 24–32 extend beyond the transformer to form a terminal portion 35.

Conductors 18 and 20 are bifilar wound in a substantially helical path over the insulator 14 to produce substantially unity coupling between the two windings. The double-threaded spiral or helical coils described above are known in the transformer art as bifilar coils. However, the present invention is not limited to bifilar windings and may include three or more conductors (trifilar and higher order filar windings) in close juxtaposition with each other and wound simultaneously.

As best seen in FIG. 7, the secondary coils labeled S each comprise two turns of the conductor 18. Each of the start connections of the secondary coils is soldered or otherwise electrically connected to the bus conductors 24. Each of the finish connections of the secondary coils is soldered or otherwise connected to the bus conductor 26. Thus, as shown in FIG. 7, there are six secondary coils S, each consisting of two turns, connected in parallel to the bus conductors 24 and 26. A typical one of the coils $S_j$ is so legended in FIG. 7, so that the start, the two turns, and the end more easily can be traced.

Lead 38, which extends along the underside of the first layer 16 of conductors, goes to one end of the primary coil of the transformer where it becomes the start turn 36 of the primary coil. Since the primary coil P is bifilar wound with the secondary coils S, very close coupling is present between the secondary coils and the adjacent portions of the primary coil, providing a coupling coefficient better than 0.99. To provide such high coupling coefficient the number of turns and total length of all of the secondary coils should be the same as the total number of turns and total length of the primary coil.

In practice, however, making the connections of the secondary coil to their bus conductors 24, 26, 30 and 32 results in the total length of the secondary coil being slightly less than the total length of the primary coil. As shown in the drawing (FIG. 7), each secondary coil S is slightly shorter than its corresponding increment of the primary coil P by the amount roughly of the spacing that exists between the inner facing edges of the corresponding bus conductors 24 and 26. However, this shorter length does not effectively alter the turns ratio present between the coils. The important criterion is that the turns of the secondary and primary windings are wound bifilar on a one for one basis. The total length of the primary coil should be effectively the same as the total length of the turns in all of the secondary coils. By effectively the same is meant that the fields created by the primary turns are coupled to the secondary coils effectively on a one-to-one basis. This effective ratio between the primary and secondary turns should be maintained as close to unity as possible.

As an aid in understanding the construction of the transformer of the present invention, the following describes the process of making the transformer. In FIG. 3 insulator 14 is a square cylinder of stiff paper. It may be mounted over a winding mandrel (not shown). The hollow 40 within insulator 14 is of square cross-section and this permits a square cylindrical ferrite core, such as core 12 to be located within the hollow after the coils are formed. Tool 42 is used during the assembly procedure. Tool 42 is an insulating stiff sheet member such as a strip of wood which is not as wide as a side of the insulating cylinder 14. In FIG. *6a* the tool 42 is shown connected to the first set of conductors 24 and 26. This is accomplished by fastening the tool 42 and conductors 24 and 26 to the insulator 28, which, as already mentioned, may be a sheet of kraft paper. Conductors 24 and 26 are mounted on insulator 28 in their final spaced relationship as it will occur on the transformer.

In FIG. 3, the end of tool 42 is placed initially over end 46 of the insulator 14. At this time bifilar conductors 18 and 20 having been previously attached to the insulator 14 in a conventional manner, are wound. The first turn 48 (conductor 18) of a secondary coil is wound over the tool 42. The first turn of the primary coil (conductor 20) is wound over the insulator 14 in front of the end 44 of the tool 42. As can be seen, the conductor 20 next to 48 is in direct contact with the insulator 14 and it was placed directly in front of the leading edge 44 of the tool 42 and the preceding (start) turn of secondary conductor is over the tool 42. The next adjacent turn of the conductor 18 is next to 14 and the next adjacent turn of conductor 20 is next to 14. The following turn 55 of conductor 18 is again over the tool 42. Conductor 18 is placed over the tool 42 every other turn in the present embodiment as shown at 48, 55 and 52. This can be done in the alternative every turn or every Nth turn in accordance with the turns ratio desired between the primary and secondary windings as will be explained.

As seen in FIGS. 4 and 5, the first layer of windings has six loops 54–59 of secondary conductor 18 over the tool 42. The primary conductor termination lead 60 remains attached to the windings of conductor 20 while the secondary conductor 18 is severed at 62 (FIG. 5) with the end 64 of conductor 18 over the conductor 26. In forming the loops 54–59, the tool 42 is moved in the direction 66 (FIG. 3) as the windings are put in place.

The tool 42 is moved forward in the direction 66 every second turn so that at the appropriate location one of the loops 54–59 can be formed over the tool 42 while the next adjacent turn of the primary conductor 20 can be placed in front of the end 44. Eventually, the entire tool 42 will be through all of the loops with the end 44 protruding through the other side of the transformer assembly. The tool 42 is pulled in the direction 66 until the bus conductors 24 and 26 are pulled through the loops 54–59 and are in the position illustrated in FIGS. 1 and 2A. The tool 42 is separated from the conductors 24 and 26 by severing the insulator 28 at the junction between tool 42 and conductors 24 and 26. Other means for connecting the tool 42 to conductors 24 and 26 may be employed, such as cementing the abutting ends thereof.

In the next step the loops 54–59 of secondary filament 18 are soldered or otherwise electrically connected to the conductors 24 and 26. This can be achieved without removing the insulation in a well known manner. Connections to the bus conductor 24 form the start terminations for each of the secondary coils S and the connections to the bus conductor 26 form the finish terminations for each of the secondary coils S. The portions of conductor 18 between the conductors 24 and 26 in each of the loops 54–59 are then removed.

An insulating layer 22 of kraft paper is then placed over the first winding layer and the conductors 24 and 26. At this point the assembly will appear as shown in FIG. 7. The conductors for the second layer 23 are then wound over insulation 22, the winding proceeding from the end 65 of the structure toward the end at which the start turn 48 is located, that is, in a direction opposite to direction 66. The process is similar to what has already been described and is continued until all of the windings are completed as shown in FIG. 2*a*. The primary finish lead 70 (FIG. 1) is placed parallel and sufficiently separated from primary start lead 38 for electrical insulating purposes. The secondary coils in the upper layer 23 (FIG. 2*a*) have their start and finish terminations connected respectively to conductors 30 and 32 which are respectively over and juxtaposed with the conductors 24 and 26 of the lower layer 16. While only two layers of windings are illustrated it is readily apparent that there may be many more layers. It is possible with such a construction that turns ratios of 20 to 1 or greater may be provided with a simple construction and very close coupling between the secondary and primary windings achieved. Whether the secondary coils are considered to be primary and the primary coils secondary is a matter of choice. In the present illustration the transformer is wound as a step down transformer. In this example there are two groups of secondary windings. In one group, all of the start windings connect to bus 24 and all of the finish windings to bus 26. In the other group, all of the start windings connect to bus 30 and all of the finish windings to bus 32. The busses have sufficient current carrying capacity for all secondary coils connected to them. The juxtaposed start conductors 24 and 30 may then be connected together and the juxtaposed finish conductors 26 and 32 may be connected together as shown schematically in phantom in FIG. 2*a*. This is done for secondary conductors for each layer in the case where more than two layers are used. The resultant construction provides extremely low inductance leakage.

For example, in a 720 watt transformer operating at 40 KHz the total "on" time of the transformer in a given cycle is 10 microseconds. Once the transformer is turned on, the voltage across the primary increases almost instantaneously and the current commences flowing, forming a current pulse. The slope of the current pulse is a function of the leakage inductance. The leakage inductance, in turn, is a function of the coupling between the primary and secondary coils. The greater the turns mismatch, that is, the greater the difference between the total number of turns of secondary coils as compared to primary coils and the greater the spacing between coils, the higher the leakage inductance. The higher leakage inductance produces a more gradual slope of the leading edge of the current pulse which in turn limits the energy that can be transferred to the secondary per cycle. When the transformer is turned off, the energy stored in the leakage inductance would produce a voltage spike in the primary. The higher the energy of the voltage spike, the more destructive and the greater is the need for protective circuitry at the switching means (not shown). In a conventional transformer of the power described above, the slope of the current pulse usually would be 3 to 5 microseconds. That slope represents lost power and, in effect, 10 to 17 percent of the (on time) power produced by the transformer. That power cannot be used for useful work.

A transformer constructed and operated in accordance with the present invention, operating at 720 watts and 40 KHz, having 18 to 1 turns ratio with 36 primary turns and 18×(2 turn) secondary coils was measured to have a leakage inductance of about 16 microhenries and an open circuit inductance of 10 millihenries. This is utilizing a test signal of 10 KHz at 100 milliamp current. Both secondary and primary windings have conductors of the same diameter to provide optimum coupling. This transformer has a current rise time of less than 500 nano seconds per ampere.

A transformer described herein is particularly useful when switched by high voltage power transistors. Such a transformer generates pulses having approximately 50 percent duty cycle. The power applied to the transformer may be from a 240 to 380 volt source on the primary providing a 13 to 21 volt output.

What is claimed is:

1. A closely coupled multi-layer transformer comprising: a core, a first coil of insulated electrically conductive wire, N second coils of insulated electrically conductive wire each having T turns where N is greater than 4, said first coil having M turns where M is about N×T, the turns of all said coils being wound about said core about a common axis and forming at least two concentric cylindrical layers of turns, each turn of the second coils being adjacent a separate, different turn of the first coil to form an array of alternating first and second bifilar coil turns along each said cylindrical layers, and at least two pairs of spaced current carrying conductors, one pair between the inner and outer layers and corresponding to the inner layer and a second pair over and corresponding to the outer layer, one conductor of each pair being connected to one end of each second coil of the one conductor's corresponding layer and the other conductor of each pair being connected to the other end of each said second coil of the other conductor's corresponding layer.

2. The transformer of claim 1 wherein the conductors are straight members substantially parallel to each other, the one and other conductors being spaced from each other on the same side of said core, the outer one conductor being over the inner one conductor and the outer other conductor being over the inner other conductor, the one conductors being connected to each other at one end thereof and the other conductors being connected to each other at one end thereof.

3. The transformer of claim 2 wherein said conductors are plane sheet members.

4. The transformer of claim 2 further including an insulating sheet member between said conductors and their corresponding layers.

5. A transformer comprising:

a plurality M of insulating cylinders on a common axis, where M is an integer equal to at least 2;

a plurality M of layers of insulated conductors, each layer wound on a different cylinder, each layer being one conductor deep, each such layer being formed of first and second conductors concurrently wound side-by-side so that each pair of adjacent turns wound on an insulating cylinder is formed of a first and a second conductor, respectively, each first conductor being a continuous conductor between an input end and an output end of that conductor and forming a first coil of the transformer, each second conductor including breaks therein, each break occurring after each N turns of the second conductor, where N is an integer equal to at least 1, each second conductor having an input end at one end thereof, an output end at the other end thereof, and an input and output end at each break, each N turns of each second conductor defining a second coil of the transformer, each second coil having an input end either at a break or at the input end of the second conductor, depending upon the position of that second coil, and each second coil having an output end either at a break or at the output end of the second conductor, depending upon the position of that second coil; and M groups of buses, each group comprising first and second buses extending parallel to said axis of said cylinders, each group of buses being located between two layers of conductors or, in the case of the outermost of the layers, beyond said outermost layer, each group of buses for connection to the layer between it and said axis, and the input ends of the second coils of each layer being conductively connected to the first bus for that layer and the output ends of the second coils of each layer being conductively connected to the second bus for the layer, one end of all buses extending from the transformer to provide convenient places where connections to all second coils may be made.

* * * * *